United States Patent [19]

Allen

[11] Patent Number: 4,979,829

[45] Date of Patent: Dec. 25, 1990

[54] CEMENT MIXING WITH VIBRATOR

[75] Inventor: Thomas E. Allen, Comanche, Okla.

[73] Assignee: Halliburton Company, Duncan, Okla.

[21] Appl. No.: 371,566

[22] Filed: Jun. 26, 1989

[51] Int. Cl.[5] ..... B28C 5/08; B28C 5/26

[52] U.S. Cl. ..... 366/66; 366/118; 366/137

[58] Field of Search ..... 366/108, 117, 118, 119, 366/122, 123, 128, 31, 64, 65, 66, 120, 124, 125, 126, 31, 136, 137; 166/286, 177, 249

[56] References Cited

U.S. PATENT DOCUMENTS

| | | | |
|---|---|---|---|
| 1,947,941 | 2/1934 | Jackson | 366/122 |
| 2,775,434 | 12/1956 | Probst | 366/120 |
| 2,966,804 | 1/1961 | McCarthy | 366/120 |
| 3,310,129 | 3/1967 | Sawyer | 366/117 |
| 4,429,743 | 2/1984 | Bodine | 166/177 |
| 4,471,838 | 9/1984 | Bodine | 166/249 |
| 4,483,695 | 11/1984 | Covey | 366/123 |
| 4,544,031 | 10/1985 | Bodine | 166/177 |
| 4,736,794 | 4/1988 | Bodine | 166/286 |
| 4,759,632 | 7/1988 | Horiuchi | 366/118 |

OTHER PUBLICATIONS

Exhibit B-brochure entitled "Wyco Square Head Concrete Vibrators", of The Wyco Tool Company, Chicago, Ill., Catalog No. VE-1282 (undated).

Exhibit C-brochure No. WPV-683 entitled "Wyco Pneumatic Concrete Vibrators", The Wyco Tool Company, Chicago, Ill. (undated).

Exhibit D-brochure of Minnich Manufacturing Company, Inc., Mansfield, Ohio, entitled "Heavy-Duty Hydraulic Concrete Vibrators" (undated).

Exhibit E-paper of Inam Jawed et al., entitled "Effect of Vibration on the Hydration of Portland Cement and $C_3S$ Pastes" (undated).

Exhibit A-brochure of Piezo Sona-Tool Corporation of Carpinteria, Calif., entitled "Piezo Sona-Tool Test Data", 4/17/84.

*Primary Examiner*—Robert W. Jenkins

*Attorney, Agent, or Firm*—James R. Duzan; L. Wayne Beavers

[57] ABSTRACT

A casing string is cemented in a borehole of a well. The cement is prepared by introducing water and dry cement material into a mixing vessel. The water and dry cement material are mixed in the mixing vessel to form a cement slurry. The mixing is accomplished by agitating the slurry to cause the slurry to circulate within the vessel, and while agitating the slurry, transmitting vibrational energy into the slurry and thereby aiding in the wetting of the dry cement material in the slurry. This also aids in removing entrained air from the slurry. The slurry is then pumped into an annulus between the casing string and the boreholes.

6 Claims, 1 Drawing Sheet

CEMENT MIXING WITH VIBRATOR

BACKGROUND OF THE INVENTION

1. Field Of The Invention

The present invention relates generally to the mixing of cement slurries, and more particularly, but not by way of limitation, to the mixing of very high density, high viscosity, cement slurries to be pumped down a well to cement a casing string in a well bore.

2. Description Of The Prior Art

In the construction of oil wells, one necessary operation is the cementing of a casing string of the oil well in a bore hole. This is accomplished by pumping a cement slurry down the casing string, or down a smaller pipe located within the casing string, and then forcing the cement upward into an annular space between the casing string and the bore hole.

For various reasons, it is sometimes desired to utilize cement slurries which are highly viscous and/or densified for this cementing operation. These slurries, which often contain saturated salt, large quantities of silica flour, gels or bentonite, and/or other thickening additives, are generally difficult to mix. They are difficult to mix because they have a tendency to entrain air, they are highly viscous, they have high surface area wetting requirements caused by large amounts of material such as silica flour, and because of chemical reactions taking place. A result is that often the slurries contain an excess of entrained air, e.g., greater than 3%.

High viscosity makes it difficult to disperse the bulk materials to obtain a uniform slurry, and increases the problem of removing entrained air. The result is that entrained air often causes difficulty in measurement and control of slurry density and causes pump priming problems. Another difficulty is that high viscosity slurries sometimes require that mixing rates be slowed to as low as 1½ barrels per minute. Additionally, high surface area materials such as silica flour are hard to wet, and tend to create unwetted lumps, thus the resultant slurry is likely not to be fully mixed or homogeneous.

Prior art methods of mixing such slurries have relied solely upon mechanical agitation of the slurry such as with rotating blade-type agitators, recirculating pumps or the like to mix the dry cement material with water.

Also, the prior art has included the use of vibrational energy to aid in placing cement downhole in a well.

U.S. Pat. No. 4,736,794 to Bodine discloses a method for the sonic cementing of downhole well casings. While the cement is being flowed into the annulus surrounding the casing, sonic energy is transmitted to the bottom of the casing and operates to assure that cement fills the area around the casing in a uniform manner.

Additionally, in more conventional construction operations such as the pouring of concrete structures, roadways, and the like, it is well known to utilize concrete vibrators to aid in placement of the concrete to make sure that it completely fills forms. These concrete vibrators can be hydraulically, pneumatically or electrically powered and typically include an elongated vibrator head either cylindrical or square in cross section having a cross-sectional dimension on the order of two to three inches, and having a length on the order of twelve to eighteen inches.

In both the casing cementing operation of the Bodine '794 patent, and in the prior art use of concrete vibrators, the vibrational energy has been used for the purpose of placing concrete.

SUMMARY OF THE INVENTION

The present invention provides apparatus and methods utilizing vibrational energy to aid in the mixing of cement slurries before those slurries are placed at their final point of usage.

As applied to the cementing of a casing string in a borehole of a well, the method includes steps of introducing water and dry cement material into a mixing vessel. The water and dry cement material are mixed in the vessel to form a cement slurry which typically includes lumps of dry cement material. This mixing includes steps of agitating the slurry to cause the slurry to circulate within the vessel, and while agitating the slurry, transmitting vibrational energy into the slurry to thereby aid in disintegration and subsequent wetting of the lumps of dry cement and other material in the slurry.

The slurry produced in this manner is then pumped into the annulus between the casing string and the borehole to cement the casing string in place.

By this technique, very high density cement slurries can be mixed much more thoroughly and much faster than they otherwise could be in the absence of the use of vibrational energy. The resulting slurries also have less entrained air than they otherwise would. The effect of the vibrational energy is to cause lumps of dry cement material to rapidly disintegrate so that a much more homogeneous cement slurry is produced than otherwise could be.

Preferred apparatus for carrying out these methods are also disclosed.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
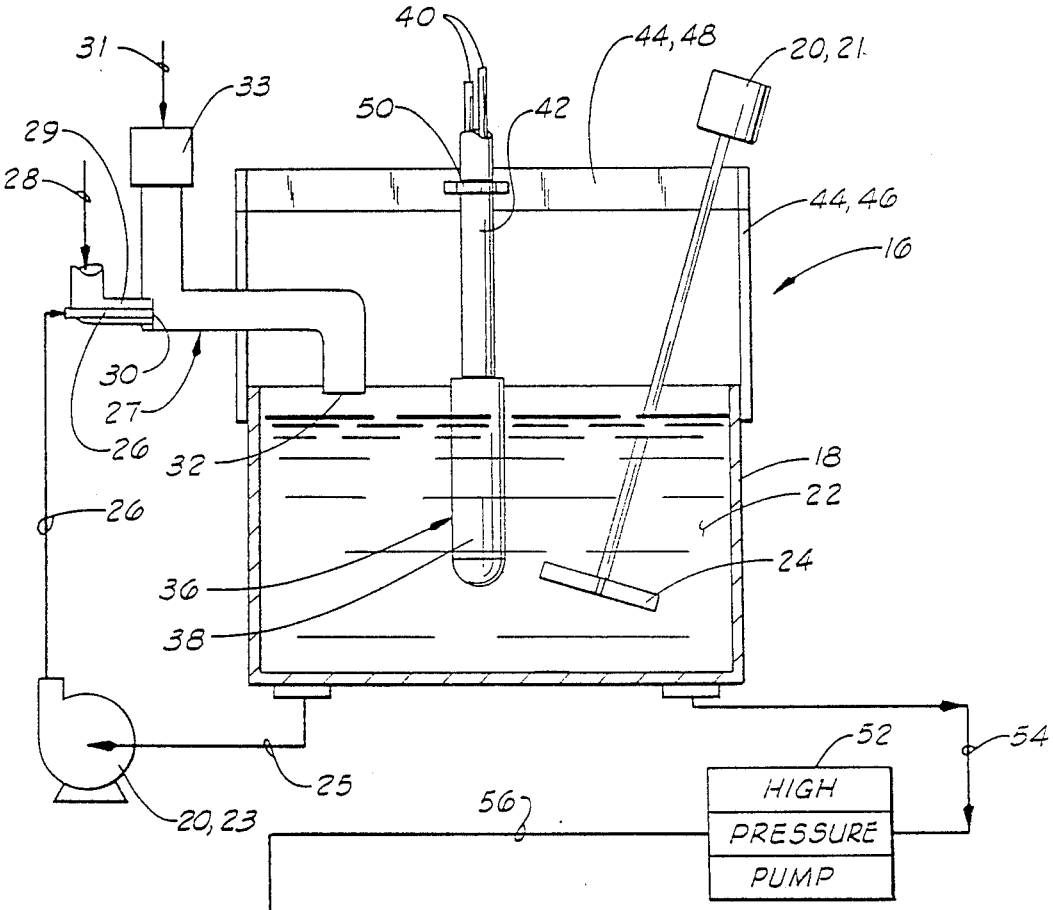
FIG. 1 is a schematic illustration of a cement mixing apparatus, an oil well, and associated equipment for cementing a casing string of the oil well.
Figure 1:
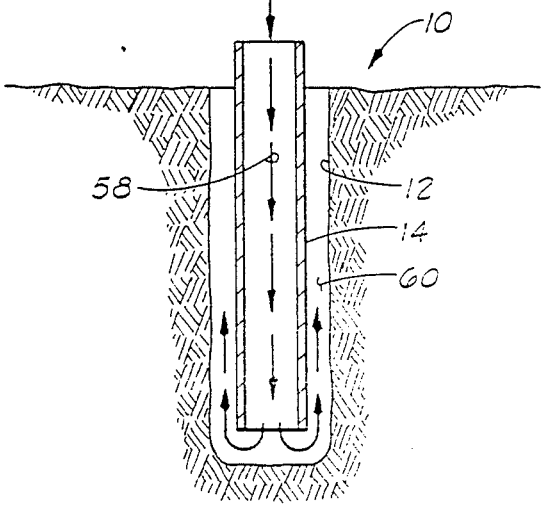

Referring now to the drawings, and particularly to FIG. 1, a well 10 is there schematically illustrated having a borehole 12, and a casing string 14 which has been located in the borehole 12.

A cement mixing apparatus 16 is generally illustrated. Apparatus 16 includes a mixing tub or mixing vessel 18 and agitator means 20, associated with the mixing tub 18, for circulating a cement slurry 22 in the mixing tub 18 and for providing mixing energy.

The tub 18 typically has a volume of from three to five barrels.

The agitator means 20 illustrated includes both a rotating blade type agitator 21, and a recirculating pump 23.

The rotating blade type agitator 21 includes a multi-bladed paddle 24, the blades of which have a diameter in the range of from about twelve inches to about twenty-four inches, and have a height on the order of four inches. The rotating blade agitator 21 is typically a relatively low speed agitator which typically would operate at approximately 250 rpm.

The recirculating pump 23 draws slurry from tub 18 through a suction line 25 and returns the slurry to the tub 18 through a discharge line 26. Located in the discharge line 26 above the open upper end of tub 18 is a mixing eductor 27.

In the mixing educator 27, the slurry discharge line 26 is axially located. A water supply stream 28 is introduced into an annular area 29 surrounding an end 30 of discharge line 26.

A stream 31 of dry cement material is supplied to mixing eductor 27 and is drawn into the mixing eductor 27 by the fresh water and recirculated slurry exiting annular area 29 and end 30 of discharge line 26, respectively. The recirculating slurry, clean water stream 28, and dry cement material 31 exit an outlet 32 of the mixing eductor into the tub 18.

As will be appreciated by those skilled in the art, the stream 31 of dry cement material will typically be conveyed by a pneumatic conveying system (not shown) in combination with the eductor 27 just described. The flow of the stream 31 of dry cement material is controlled by a throttling control valve 33. Other types of dry material feed systems, such as a screw type feeder or a gravity feed system could also be utilized.

Also, it is noted that the general arrangement of the agitator 21, recirculating pump 23 and eductor 27 is only one possible form of the agitator means 20. Other combinations of agitating devices could also be used.

The stream of water 28 and the stream of dry cement material 31 are introduced into the tub 18 through the mixing eductor 27. In the tub 18, the water and dry cement material, with other additives, are mixed by the agitator means 20, 21, 23 to form the slurry 22. When these materials are first introduced into the tub 18, the slurry 22 will typically include lumps of the dry cement material which are not completely wetted. When the term "lump" is utilized in this disclosure, it is being used only in a general sense to refer to a cluster of individual cement particles which initially stick together and are not completely wetted. The present invention is directed to systems for aiding in the disintegration and subsequent wetting of these lumps or clusters of dry cement material as the slurry 22 is circulated within or through the tub 18. This is accomplished by means of a vibrator 36.

The vibrator 36 includes an elongated vibrator head 38 having flexible power supply lines 40 extending thereto. The power supply lines 40 are shown as being received within a resilient sheath 42 which may for example be a length of rubber tubing or the like.

A support structure 44 including vertical members 46 and a cross member 48 is connected to the tub 18 and extends above the tub 18.

The vibrator head 38 of vibrator 36 is suspended in the slurry 22 within the mixing tub 18 from the support structure 44 by its power supply lines 40 and the sheath 42. The sheath 42 is physically connected to the cross member 48 of support structure 44 by a U-bolt 50. In this manner, vibrational energy from the vibrator head 38 is substantially isolated from the mixing tub 18.

The vibrator 36 may for example be a model HV-4-4 concrete vibrator manufactured by Minnich Manufacturing Company, Inc., of Mansfield, Ohio, as further described in the examples set forth below.

While the slurry 22 is being agitated by the mechanical agitator means 20, the vibrator 36 is operated to transmit vibrational energy into the slurry 22, thereby aiding in the disintegration and subsequent wetting of the lumps of dry cement material 34 contained in the slurry 22.

Vibrational energy generated by vibrator 36 is relatively high frequency, and preferably is in a range of from about 7,000 to about 12,000 cycles per minute. Generally speaking, the vibrational energy can be described as preferably having a frequency of at least about 7,000 cycles per minute.

As is shown by the examples set forth below, the cement slurry 22 can be thoroughly mixed much faster as a result of the use of the vibrator 36 as compared to a similar mixing process without the use of vibrational energy. Thus, the dry cement material 34 can be added to the tub 18 at a much higher rate than it could be added if vibration were not being used.

Additionally, the slurry 22 can be mixed much more thoroughly as a result of the use of vibrational energy, thus resulting in much more homogeneous slurries 22. In addition to the observable disintegration of relatively large lumps of material, it is noted that even in a slurry that appears to be well mixed, there are macroscopic clusters of dry cement material which are not fully wetted. It is believed that these macroscopic clusters or lumps are further broken down by the use of vibrational energy to produce more homogeneous slurries.

The advantages just described apply particularly to the viscous, harder to mix slurries. Not all slurries have difficulty in mixing, and the amount of benefit gained by vibration is slurry design specific.

The use of vibrational energy is particularly advantageous for use with slurry designs which contain saturated salts, large quantities of silica flour, gels or bentonite, and/or other additives which contribute to mixing problems.

The viscous slurries for which the present invention is most useful include two broad general categories. First, there are slurries which are very dense due to a high solids loading, and the viscosity of those slurries results in large part from the presence of high concentrations of solids materials. Such high density slurries may have densities in a range of from about 17 to about 19 lbs/gal. The second general category of slurries are those which are viscous because of the additives included in the slurries and because of chemical reactions in the slurries caused by those additives. This second group of slurries may or may not also be relatively high density slurries.

The use of vibrational energy in mixing these very high density and/or high viscosity slurries aids in the removal of much of the entrained air which is typically contained in such slurries.

After the cement slurry 22 is mixed in the tub 18, a high pressure pump 52 takes the cement slurry from the tub 18 through a suction line 54 and the cement is pumped through a discharge line 56 down into the casing 14 as generally indicated by arrows 58. The cement slurry flows down the interior of the casing 14, or in many cases down a smaller pipe located concentrically within the casing 14, and then upward around the bottom of the casing 18 to fill an annular space 60 between the casing 14 and the borehole 12. Once this cement sets and cures within the annular space 60, it becomes an integral part of the well 10 holding the casing 14 in place within the borehole 12.

Through the use of the present invention, cement slurries 22 having a higher quality, that is much more homogeneous slurries, can be mixed at higher rates than they could be with prior art techniques, thus providing improved cementing of the casing 14 within the borehole 12. This is particularly true where relatively high density and/or high viscosity cement slurries are desired.

Also the removal of entrained air from the slurry is a significant advantage in that subsequent measurements of slurry density are made more accurate. These density measurements are made with a densometer, and the presence of entrained air causes the densometer to read light.

APPARATUS AND PROCEDURES FOR EXAMPLES 1 THROUGH 4

Figure 2:
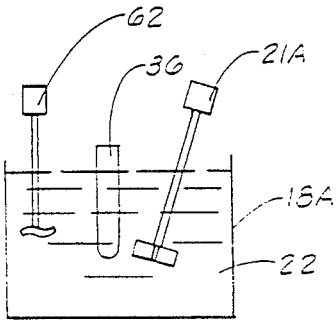
FIG. 2 is a schematic illustration of a laboratory test apparatus.

Examples 1 through 4 utilized a common laboratory apparatus and procedure which can be generally described with reference to FIG. 2. Two different slurry designs were tested in a batch tank 18A having approximately twenty-gallon capacity. The batch tank 18A had a low speed paddle agitator 21A, and also included a high speed dispersator 62. In addition, one hydraulic-driven concrete vibrator 36 operating at approximately 8,000 rpm was operated in conjunction with the agitators. The dispersator 62 operated at 10,000 rpm. The low speed agitator 21A had a six-inch diameter paddle one inch in height operated at 250 rpm, driven by a Servodyne D.C. motor which provides speed control and torque measurement. The vibrator 36 was a hydraulic vibrator model HSV-4-4 manufactured by Minnich Manufacturing Co., which can produce up to 3.5 horsepower while operating from 8,000 to 10,000 rpm. The two slurries tested are generally referred to as a silica flour slurry and a saturated salt slurry. Each was mixed both with and without the vibrator. The time to fully mix all of the dry bulk material with the required water was recorded.

EXAMPLE NO. 1

Silica Flour Slurry (Without Vibrator)

The silica flour slurry was prepared according to the specification shown in the following TABLE I:

TABLE I

| SILICA FLOUR DESIGN | Percent By Weight | 15 Gallon Batches |
|---|---|---|
| Class "H" (API) Cement | 100 | 102.0 lbs |
| SSA-1* (silica flour) | 60 | 61.4 |
| SSA-2* (Okla. No. 1 sand) | 40 | 40.9 |
| Gas Stop* (additive to prevent gas migration) | 0.6 | 0.61 |
| CFR-3* (friction reducer) | 0.75 | 0.77 |
| Water | 52 | 53.17 |

*Indicates a trademark of Halliburton Services, Duncan, Oklahoma

The slurry produced from the specifications of TABLE I had a density of 17.26 lbs/gal. The formula yielded 1.84 cubic feet of slurry per 94-pound sack of cement.

This slurry was first mixed without the use of vibration. The cement blend was added to the water as rapidly as possible while the paddle agitator 21A and the dispersator 62 were operating. Cement addition was slowed or stopped if there was an appearance of too much dry material on the surface (material was not being incorporated). At approximately sixteen minutes, all of the material had been added and no further change to the appearance of the slurry seemed to occur with additional agitation. Therefore, the slurry was declared to be mixed (as best as possible with the existing agitation). The vibrator was then turned on. It immediately caused air to be expelled and eliminated the lumps in the slurry that had been previously mixed.

EXAMPLE NO. 2

Silica Flour Slurry (With Vibration)

This test was conducted similar to Example No. 1, except that the vibrator was turned on initially as the bulk cement was added to the water. In this case, it took approximately 7.5 minutes to declare the slurry fully mixed and homogeneous. At 8.5 minutes, the vibrator was turned off.

EXAMPLE NO. 3

Saturated Salt Slurry (Without Vibration)

The saturated salt slurry was prepared according to the specifications shown in the following TABLE II:

TABLE II

| SATURATED SALT DESIGN | Percent By Weight | 15 Gal Batches |
|---|---|---|
| Class "H" API Cement | 100 | 117.3 lbs |
| SSA-1* (silica flour) | 35 | 41.0 lbs |
| Hi-Dense* #3 (heavy-weight additive) | 10.64 | 12.5 lbs |
| Salt | 20.74 | 24.3 |
| Halad* - 24 (fluid loss additive) | 1.0 | 1.17 |
| CFR-3* (friction reducer) | 0.75 | 0.88 |
| Fe-2* (fluid loss aid) | 0.22 | 0.26 |
| D-air* (entrained air reducer) | 0.25 | 0.29 |
| Diacel A* (cement accelerator) | 6.0 | 7.04 |
| Water | 55.83 | 65.47 |

*Indicates a trademark of Halliburton Services, Duncan, Oklahoma

The slurry prepared according to the specification of TABLE II had a density of 16.38 lbs/gal. This recipe yielded 1.606 cubic feet of slurry per 94-pound sack of cement.

The saturated salt slurry was first tested without vibration to determine the ability of the mixing system to mix and incorporate the bulk powder into the water without the use of a vibrator. It took approximately 6.75 minutes. The surface of this batch had lumps of dry material and this condition did not appear to improve with time. At approximately 8.75 minutes, the vibrator was turned on to see the effect of vibration on breaking up the lumps of dry material. This was very effective and almost immediately broke all of the visible lumps down and incorporated them into the slurry. The effect was to significantly increase the viscosity of the slurry. The paddle torque of agitator 21A was noticed to increase approximately 50% due to what is believed to be the incorporation of previously unwetted solids.

EXAMPLE NO. 4

Saturated Salt Slurry (With Vibration)

This test was conducted similar to Example No. 3 except that the vibrator was turned on from the beginning of the test while the dry material was being added to the water. All of the material was incorporated within the water and the slurry was declared mixed without any lumps after 3.75 minutes. The vibrator was left on until approximately test time of 9.5 minutes.

From the four tests set forth in Examples Nos. 1–4 above, it is clear that the vibrator 36 does allow or aid the incorporation of bulk material into water, particularly with the thicker fluids. The time to incorporate the bulk material into the water was cut approximately in half when the vibrator was used. Also where visible lumps of dry material were present while mixing without the vibrator, those lumps were quickly eliminated after the vibrator was turned on.

EXAMPLE NO. 5

Field Test

One attempt has been made to test the present invention on an actual field job. A very high density slurry was prepared according to the specification shown in the following TABLE III:

TABLE III

| | |
|---|---|
| Premium Cement | 1135 sks |
| SSA-1* (silica flour) | 35% |
| Salt | 20.1 lb/sk |
| Hi-Dense No. 3* (heavyweight additive) | 29.0 lb/sk |
| HALAD 24* (fluid loss additive) | 0.8% |
| CFR-3* (friction reducer) | 1.0% |
| FE-2* (fluid loss aid) | 0.2% |
| D-Air-1* (entrained air reducer) | 0.25% |
| Diacel "A"* (cement accelerator) | 9.0% |

*Indicates a trademark of Halliburton Services, Duncan, Oklahoma

The slurry prepared according to the recipe of TABLE III had a density of 17.6 lbs/gal. The recipe yielded 1.81 cubic feet of slurry per 94-pound sack of cement. 6.5 gallons of water were utilized per 94-pound sack of cement.

The field equipment utilized a five-barrel capacity mixing tub 18. Conventional low speed rotating paddle agitators 21 were utilized in the tub. The vibrator utilized was a Model HSV-4-4 manufactured by Minnich Manufacturing Company.

Although it was apparent that the vibrator had a very significant effect on the slurry, this particular slurry design was of such a high density that the use of the vibrator slowed the overall mixing process. This was believed to be due to the fact that the use of the vibrator caused a much faster incorporation of the bulk material into the slurry thus causing excessive viscosity. The vibrator did aid in reducing gel strength of the slurry so that it could be agitated by the conventional agitators. When the vibrator was turned off, the slurry was so thick that the agitators would not move the surface of the cement slurry in the tub. When the vibrator was restarted, the agitators were able to move and circulate the slurry. The conclusion is that the vibrator does aid significantly in the incorporation of bulk material into the liquid, but with this particular slurry design it had an adverse effect on overall mixing speed. It is believed that by redesign of the mixing system, the use of the vibrator can be advantageous even with the cement design of TABLE III which is very difficult to handle.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A cement mixing apparatus comprising:

a mixing tub;

agitator means, associated with said mixing tub, for circulating a cement slurry in said mixing tub;

a support structure, connected to said mixing tub and extending above said mixing tub; and a vibrator including an elongated vibrator head having a flexible power supply line connected to said vibrator head, said vibrator head being suspended in said mixing tub from said support structure by said power supply line so that vibration of said vibrator head is substantially isolated from said mixing tub by said power supply line.

2. The apparatus of claim 1, wherein:

said power supply line is received through a resilient sheath, said sheath being physically attached to said support structure.

3. The apparatus of claim 1, wherein:

said vibrator is a means for transmitting vibrational energy into said slurry and thereby aiding disintegration and subsequent wetting of lumps of dry cement material in said slurry.

4. The apparatus of claim 3, wherein:

said vibrator head vibrates at a frequency of at about 7000 cycles per minute.

5. The apparatus of claim 1, wherein:

said agitator means includes a rotating paddle agitator.

6. The apparatus of claim 1, wherein:

said agitator means includes a recirculating pump.

* * * * *